US006333600B1

(12) United States Patent
Mizobata

(10) Patent No.: US 6,333,600 B1
(45) Date of Patent: Dec. 25, 2001

(54) PLASMA DISPLAY PANEL WITH PHOTOREFLECTION/ABSORPTION

(75) Inventor: Eishi Mizobata, Tokyo (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/195,622

(22) Filed: Nov. 19, 1998

(30) Foreign Application Priority Data

Nov. 27, 1997 (JP) ..... 9-326226

(51) Int. Cl.[7] ..... H01J 17/49
(52) U.S. Cl. ..... 313/587; 313/582; 313/586
(58) Field of Search ..... 313/582, 584, 313/585, 586, 587, 517, 519

(56) References Cited

U.S. PATENT DOCUMENTS

| | | | | |
|---|---|---|---|---|
| 3,912,964 | * | 10/1975 | Kouyama et al. | 313/519 |
| 4,803,402 | * | 2/1989 | Raber et al. | 313/587 X |
| 5,182,489 | * | 1/1993 | Sano | 313/586 X |
| 5,541,479 | * | 7/1996 | Nagakubo | 313/587 X |
| 5,661,500 | * | 8/1997 | Shinoda et al. | 313/585 X |
| 5,757,131 | * | 5/1998 | Tsuchiya | 313/587 X |
| 5,932,967 | * | 8/1999 | Chikazawa | 313/587 X |
| 5,939,826 | * | 8/1999 | Ohsawa et al. | 313/587 X |
| 5,957,743 | * | 10/1999 | Konishi et al. | 313/587 X |
| 6,117,370 | * | 9/2000 | Hasegawa et al. | 313/479 X |

FOREIGN PATENT DOCUMENTS

| | | |
|---|---|---|
| 3-190039 | 8/1991 | (JP) . |
| 3-246857 | 11/1991 | (JP) . |
| 8-138559 | 5/1996 | (JP) . |
| 8-162026 | 6/1996 | (JP) . |
| 8-287834 | 11/1996 | (JP) . |
| 8-329843 | 12/1996 | (JP) . |
| 9-231910 | 9/1997 | (JP) . |

* cited by examiner

*Primary Examiner*—Ashok Patel
*Assistant Examiner*—Mack Haynes
(74) *Attorney, Agent, or Firm*—Sughrue Mion, PLLC

(57) ABSTRACT

According to this invention, there is provided a plasma display panel without reduction of luminance and with good contrast. The plasma display panel with high luminance and good contrast is provided by forming a photoreflection or photoabsorption layer for minimizing reflection of external light on the rear side of a fluorescence layer to directly radiate light emitted to the viewing side from the fluorescence layer as display light, and by reducing a reflectance on the fluorescence layer to below 25% in terms of reflection of external light which may cause contrast reduction.

4 Claims, 2 Drawing Sheets

$R_P$: Reflectance of the fluorescence layer $R_F$: Reflectance of the photoreflection layer $\alpha_F$: Transmission of the photoabsorption layer

PLASMA DISPLAY PANEL WITH PHOTOREFLECTION/ABSORPTION

BACKGROUND OF THE INVENTION

1. Field of the Invention

This invention relates to a plasma display panel, in particular a plasma display panel with high luminance and high contrast.

2. Description of the Related Art

For improving image quality of a plasma display panel, for example, JP-A 8-287834/1996 has disclosed a technique of forming a photoabsorption layer on the viewing side of the panel. FIG. 3 shows a schematic sectional view of a cell as an example of a plasma display panel of the prior art.

In a color panel, each fluorescence layer 9 is colored in R(red), G(green) and B(blue) corresponding to luminescent colors of individual cells. UV generated in a discharge space cell is radiated on the fluorescence layer 9 to emit colors assigned to individual fluorescence layers.

In addition, light observed in the viewing side includes external light besides emission light. It is light generated by reflection of incident light into the cell from the outside, on the fluorescence layer 9 and a dielectric layer 11. It may increase luminance of black display, leading to reduction of contrast ratio. To remove the external light, a photoabsorption layer 15 is formed.

The photoabsorption layer plays a role as a dielectric layer required in AC type drive, i.e., a drive procedure in which voltages with different polarities are alternately applied to a discharge cell for light emission. External light passes through the photoabsorption layer 15 twice, i.e., at incidence and reflection. On the other hand, since emission light passes once, reducing a transmission may allow contrast to be improved.

There has been disclosed, for example in JP-A 8-138559/1996, a technique for effectively taking emission light in which a wavelength-selective reflection film is formed on a rear side for effectively reflecting only emission light. Specifically, a wavelength-selective reflection film is formed on the rear side of the fluorescence layer to reflect emission light from the fluorescence layer to the rear side for effectively utilizing the emission light.

JP-As 3-190039/1991 and 3-246857/1991 have disclosed a technique in which a fluorescence layer is formed on the rear-substrate side and a technique in which a reflection film is further formed on the rear-substrate side.

One problem in the prior art is that a display luminance is reduced due to a photoabsorption layer for improving display contrast. Display luminance may vary depending on a transmission of the photoabsorption layer. A resulting display may be of high contrast and low luminance or of low contrast and high luminance.

An adequately high quality of image cannot be, therefore, displayed because a photoabsorption layer is formed on the viewing-side substrate and a reflectance of the fluorescence layer is high.

SUMMARY OF THE INVENTION

This invention has been achieved, whose objective is to provide a high-luminance and high-contrast plasma display panel without the above problems.

The above problems or objective can be solved or achieved by this invention. This invention provides a plasma display panel comprising a plurality of cells having a fluorescent material between two glass substrates, viewing-side and rear substrates, in which the fluorescent material is excited by UV energy to emit visible light, characterized in that the visible-light reflectance of the fluorescence layer is below 25% and a photoreflection layer which effectively reflects only light with a specific emission wavelength of the fluorescent material of each cell and absorbs the remaining light, is formed between a barrier rib separating cells from each other and/or a cell bottom surface, namely the surface of the rear substrate and the fluorescence layer formed on the inner surface of the cell.

This invention also provides an AC type of plasma display panel comprising a plurality of cells having a fluorescent material between two glass substrates, viewing-side and rear substrates, in which the fluorescent material is excited by UV energy to emit visible light, characterized in that the visible-light reflectance of the fluorescence layer is below 25% and a barrier rib separating cells from each other and/or a dielectric layer on a cell bottom surface, namely the surface of the rear substrate is a photoreflection layer which can effectively reflect only light with a specific emission wavelength of the fluorescent material and absorb the remaining light.

This invention further provides a plasma display panel comprising a plurality of cells having a fluorescent material between two glass substrates, viewing-side and rear substrates, in which the fluorescent material is excited by UV energy to emit visible light, characterized in that a gray photoreflection layer which does not have a wavelength distribution, is formed between a barrier rib separating cells from each other and/or a cell bottom surface, namely the surface of the rear substrate and the fluorescence layer formed on the inner surface of the cell.

This invention further provides an AC type of plasma display panel comprising a plurality of cells having a fluorescent material between two glass substrates, viewing-side and rear substrates, in which the fluorescent material is excited by UV energy to emit visible light, characterized in that a barrier rib separating cells from each other and/or a dielectric layer on a cell bottom surface, namely the surface of the rear substrate is a photoreflection layer which does not have a light distribution and can absorb light.

The plasma display panel of this invention is characterized in that the visible-light reflectance of the fluorescence layer is below 25% and the fluorescence layer has a photoabsorption or photoreflection layer on its rear side for improving contrast ratio.

In the panel of this invention, a photoabsorption layer is placed on the rear side of a fluorescence layer for minimizing reflection of external light, and therefore, a component incident on the viewing side of emission light from the fluorescence layer is displayed without passing through the photoabsorption layer. In a panel of the prior art, a photoabsorption layer is placed on the viewing side in relation to the fluorescence layer and thus the whole emission light from the fluorescence layer is displayed through the photoabsorption layer. Therefore, the plasma display panel of this invention can perform display lighter than that of the prior art.

In this invention, reflectance of a fluorescence layer is below 25%. External light is absorbed by a photoabsorption layer as is in a panel of the prior art to prevent contrast reduction, but external light reflected on the fluorescence layer cannot be removed.

The panel controlling reflectance below 25% can achieve contrast higher than that having a photoabsorption layer on the viewing side.

This invention will be described with reference to the accompanied drawings, in which FIG. 1 is a schematic sectional view of a cell of a panel of this invention (Example 1);

In these drawings, 1 is a viewing-side substrate, 2 is a rear substrate, 3 is a scanning electrode, 4 is a maintenance electrode, 5 is a transparent dielectric layer, 6 is a protective layer, 7 is a barrier rib, 7*a* is a viewing-side septum, 8 is a discharge space cell, 9 is a fluorescence layer, 10 is a photoreflection layer, 11 is a white dielectric layer, 12 is a data electrode, 13 is a dielectric layer containing a photoabsorption pigment, 14 is a barrier rib containing a photoabsorption pigment and 15 is a photoabsorption layer.

DETAILED DESCRIPTION OF THE PREFERRED EMBODIMENTS

Figure 1:
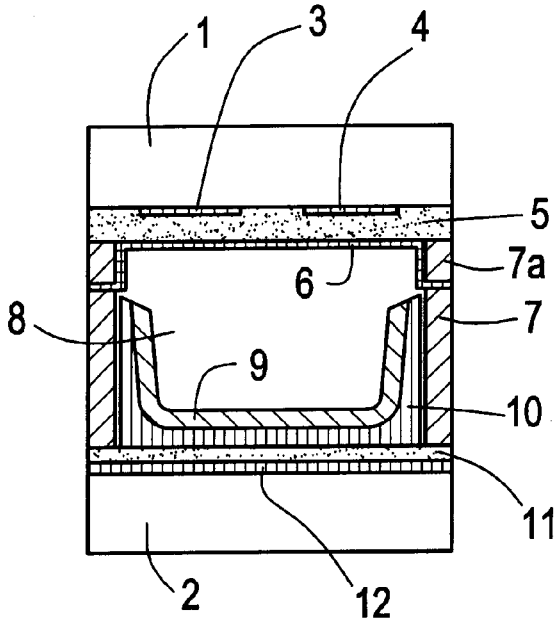

Referring to FIG. 1, a discharge space cell 8 is placed between a viewing-side substrate 1 and a rear substrate 2, and each cell is covered by barrier rib to some degree. Barrier rib are not necessarily placed on all the faces; specifically they are placed in appropriate positions depending on factors such as a process and balance of display properties. In each cell, discharge gas is enclosed.

FIG. 1 shows an AC plane discharge type of plasma display, where as electrodes, a scanning electrode 3 and a maintenance electrode 4 are placed on a viewing-side substrate 1, and a data electrode 12 is on a rear substrate 2. A transparent dielectric layer 5 and a white dielectric layer 11 required for AC type of drive are formed on each substrate. In addition, a protective layer 6 for protecting the transparent dielectric layer 5 from discharge is formed in a manner that it covers the transparent dielectric layer 5.

Arrangement of the electrodes, the dielectric layers and the protective layer may vary depending on a driving method, and give no influence on effects of this invention. Inside of each discharge space cell 8, there is provided a photoreflection layer 10 for minimizing reflection of external light, under a fluorescence layer 9, i.e., on the rear side. This photoreflection layer 10 has a visible light reflectance of about 10 to 50%, which may minimize reflection of external light.

On the photoreflection layer 10, there is formed a fluorescence layer 9 which converts UV generated in the discharge space cell 8 into visible light. It is preferable that reflectance of the fluorescence layer 9 is reduced as much as possible. In particular, when a visible light reflectance is over 25%, it may be preferable to place a photoabsorption layer on the viewing side for providing a display with high luminance and high contrast.

Operation of the plasma display panel shown in FIG. 1 will be described. A voltage is applied between the scanning electrode 3 and the data electrode 12 to write data, and then an AC voltage is applied between the scanning electrode 3 and the maintenance electrode 4 to generate plasma discharge inside of the discharge space cell 8. UV light generated by discharge is dispersed to all directions within the discharge space cell 8.

Only the UV to the fluorescent layer 9 is converted into visible light, of which the light to the viewing side passes through layers such as the protective layer 6, the transparent dielectric layer 5 and the scanning electrode 3 or the maintenance electrode 4 to be displayed on the viewing side.

Furthermore, the light incident on the rear side is partially reflected by the photoreflection layer 10 to be, as is the above, displayed on the viewing side. A visible light reflectance of the photoreflection layer 10 is about 10 to 50%, and the light other than the reflected light becomes loss.

For increasing a luminous efficiency of display, it is preferable to increase the reflectance of the photoreflection layer 10, but it may, as described later, reduce contrast due to reflection of external light. External light enters the discharge space cell 8 from the viewing-side substrate 1 and is reflected by the fluorescence layer 9 to some extent.

Furthermore, the light which has passed the fluorescence layer 9 is also, to some extent, absorbed as well as reflected. The lights reflected by the fluorescence layer 9 and the photoreflection layer 10 exist even during black display where discharge for emission does not occur, and thus may cause increase of luminance during black display, leading to contrast reduction.

Figure 4:
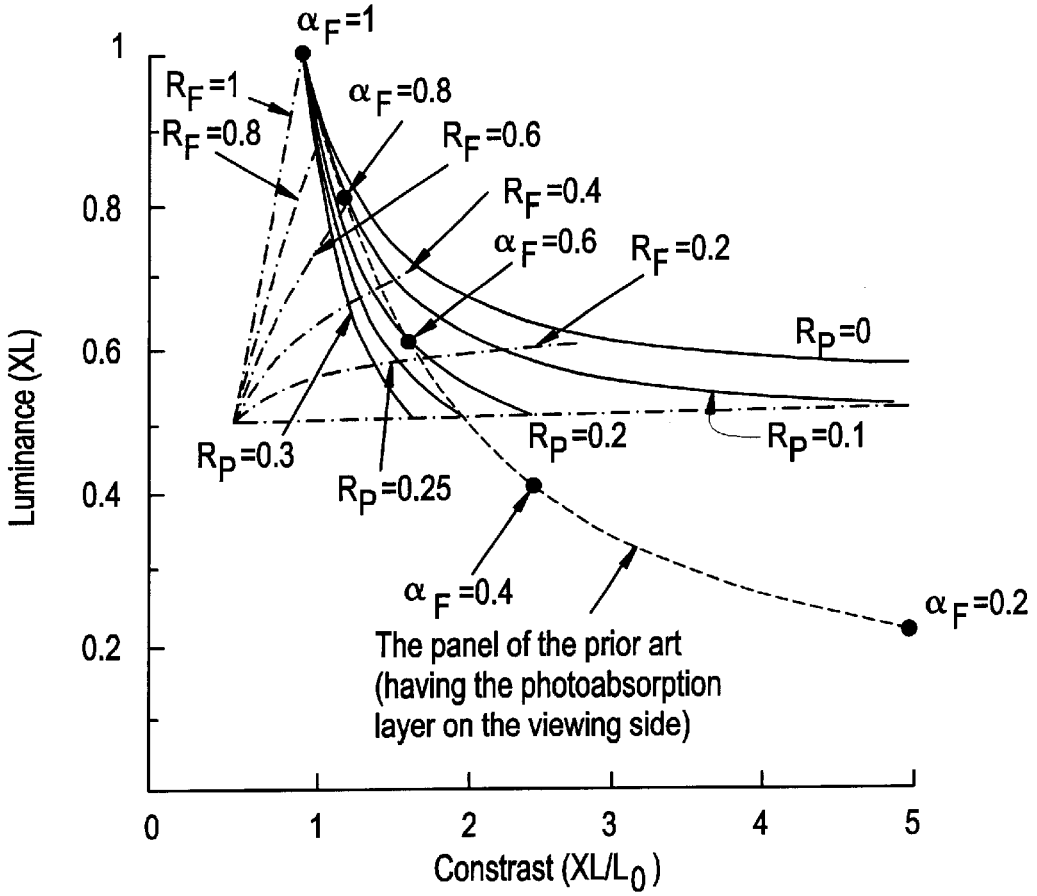
FIG. 4 is a graph showing relationship between luminance and contrast ratio during emission of a plasma display panel.

In FIG. 4 solid lines indicate the calculation results of the relationship between contrast and display luminance, changing a reflectance of the photoreflection layer 10 of the plasma display panel of this invention. In addition, broken lines in FIG. 4 indicate the calculation results of the relationship between contrast and display luminance, changing a transmission of a photoabsorption layer 15 which plays a role of reducing reflection of external light in a plasma display panel of the prior art. In the figure, L is a quantity of light from the fluorescence layer 9, and Lo is a quantity of external light.

In the plasma display panel of the prior art, display properties are independent of the reflectance of the fluorescence layer 9, while in the panel of this invention display properties are substantially dependent on the reflectance of the fluorescence layer 9. It is because in the panel of the prior art, external light totally passes through the photoabsorption layer 15, while external light reflected by the fluorescence layer 9 does not pass through the photoreflection layer 10 in the panel of this invention.

FIG. 4 indicates that when the reflectance of the fluorescence layer 9 is over 25%, the panel of the invention has a lower display luminance than the panel of the prior art, leading to poor display properties.

EXAMPLES

This invention will be specifically described with reference to, but is not limited to, Examples.

Example 1

This example will be described with reference to FIG. 1. In this example, an AC plane discharge type of plasma display panel is used, but this invention can be applied to any type of plasma display panel such as DC and AC opposite discharge types, regardless of a driving method. The panel of this example, therefore, has elements such as electrodes, dielectric layers and barrier ribs in a similar arrangement to that of a panel of the prior art.

A scanning electrode 3 for discharge and a maintenance electrode 4 are ITO(indium oxide-tin) films to pass emission light, on which an Ag trace electrode extends for reducing a resistivity. On the electrodes, a transparent glaze layer is formed as a transparent dielectric layer 5. A protective layer 6 is an MgO film. A data electrode 12 is an Ag film, on which a white glaze layer is formed as a white dielectric layer 11.

A photoreflection layer 10 and a fluorescence layer 9 characterizing this invention will be described. The photoreflection layer 10 is adjusted to have a visible light reflectance of 80% and has a thickness of 20 $\mu$m. The fluorescence layer 9 has fluorescent materials for emitting RGB corresponding to individual display colors. The fluorescent materials for R(red), G(green) and B(blue) are $(Y,Gd)BO_3$:Eu, $Zn_2SiO_4$:Mn and $BaMgAl_{10}O_{17}$:Eu, and the thickness is 5 $\mu$m for reducing a reflectance to 10%.

Operation of the panel of this example will be described. First, display luminance during emission will be discussed. In this panel, reflection of external light is sufficiently smaller than a luminance to be negligible. The panel is subject to AC type drive to generate plasma inside of the discharge space cell 8, from which UV is then generated. The UV is radiated on the fluorescence layer 9 to generate a luminescent color of each fluorescence layer corresponding to one of RGB. The fluorescence layer 9 is divided into different colors by printing.

It is preferable that the fluorescence layer 9 has a reflectance as low as possible, preferably below 10%. A fluorescence layer with a lower reflectance may be provided, using, for example, a spherical fluorescent material with a small specific surface area or a thin-layer fluorescent material. Fifty percents of the emission light is incident on the viewing side, while the remaining 50% is on the rear side.

The light incident on the viewing side passes through layers such as the protective layer 6, the transparent dialectic layer 5, the scanning electrode 3 or the maintenance electrode 4 and the viewing-side substrate 1 to be directly displayed. On the other hand, the light incident on the rear side is radiated on the photoreflection layer 10. The photoreflection layer 10 has been made by blending a white glaze with a black pigment. The black pigment may be an oxide of a metal such as iron, manganese and chromium; in this example, the glaze was blended with about 3 wt % of iron oxide to provide a material with a reflectance of 30%, which was then applied by printing.

After multiple-reflection, 28% of the light reflected by the photoreflection layer 10 is transmitted. Thus, 64% of the emission light is, in total, incident on the viewing-side substrate, i.e., 50% to the viewing side described above plus 14% (50%×28%) from the rear side.

On the other hand, during non-emission, i.e., black displaying, the display luminance depends on reflection of external light. External light entering the discharge space cell 8 is radiated on the fluorescence layer 9, 10% of which is then reflected. The remaining 90% passes through the fluorescence layer 9 and multiple-reflected between the photoreflection layer 10 and the fluorescence layer 9, 25% of which is then reflected.

Figure 3:
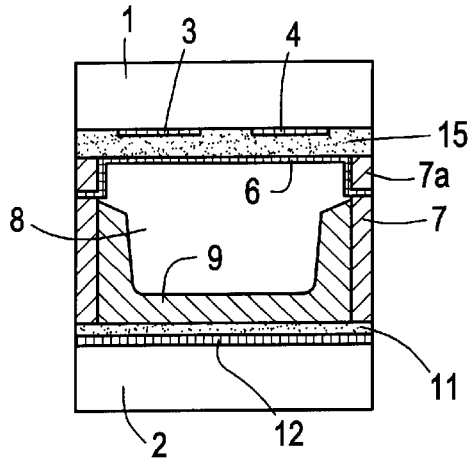
FIG. 3 is a schematic sectional view of a plasma display panel of the prior art.

Thus, 35%, i.e., 10%+25%, of the external light is, in total, displayed as reflection of external light. In the plasma display panel of the prior art shown in FIG. 3, adjusting the transmission of the photoabsorption layer 15 to 64% permits display luminance during emission to be 64% of the emission light, in which a reflectance of external light is 41%. Thus, the panel of this invention may achieve higher contrast by 17% than that of the prior art.

Example 2

Figure 2:
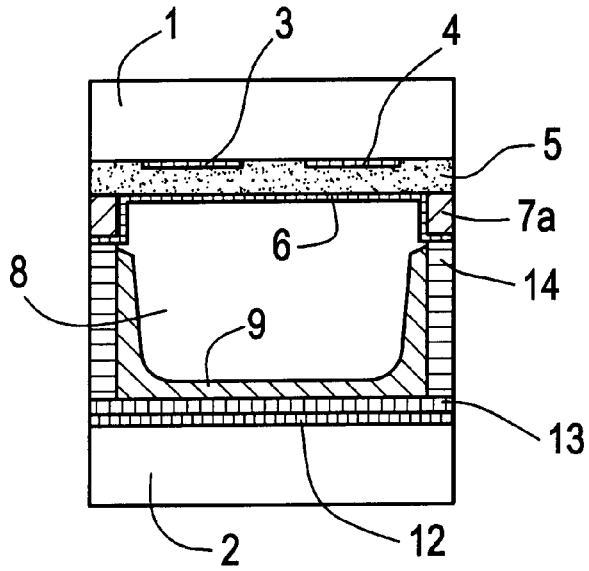
FIG. 2 is a schematic sectional view of another cell of a panel of this invention (Example 2)

It may be similarly effective that a dielectric layer 13 and a barrier rib 14 to which a black pigment is added are used as photoreflection layers as shown in FIG. 2. This example will be described with reference to FIG. 2.

In this example, an AC plane discharge type of plasma display panel is used, but this invention can be applied any type of plasma display panel such as DC and AC opposite discharge types, regardless of a driving method.

The panel of this example, therefore, has elements such as electrodes, dielectric layers and barrier ribs in a similar arrangement to that of a panel of the prior art. A scanning electrode 3 for discharge and a maintenance electrode 4 are ITO films to pass emission light, on which an Ag trace electrode extends for reducing a resistivity. On the electrodes, a transparent glaze layer is formed as a transparent dielectric layer 5. A protective layer 6 is an MgO film. A data electrode 12 is an Ag film, on which a white glaze layer containing 3 wt % of a black pigment is formed as a dielectric layer 13 containing a photoabsorption pigment and has a reflectance of 30% and a thickness of 20 $\mu$m.

Similar properties may be also provided by applying a similar material on the dialectic layer and the surface of the barrier rib. The fluorescence layer 9 has fluorescent materials for emitting RGB corresponding to individual display colors. The fluorescent materials for R(red), G(green) and B(blue) are $(Y,Gd)BO_3$:Eu, $Zn_2SiO_4$:Mn and $BaMgAl_{10}O_{17}$:Eu, and the thickness is 5 $\mu$m for reducing a reflectance to 10%.

In place of a black pigment, a colored pigment may be used, depending on a luminescent color of each fluorescent material. Colored pigments which may be used include ferric oxide for R(red), CoO.nZnO for G(green) and $CoO.nAl_2O_3$ for B(blue).

In the example shown in FIG. 1, the above colored pigments were blended in a white glaze, to adjust a reflectance of the emission light to 80% for R(red), 64% for G(green) or 73% for B(blue). It allowed an efficiency of the emission light to be increased to 82% and a reflectance of external light to be reduced to 30%.

In the example shown in FIG. 2, a panel may be produced by blending a similar pigment in the dielectric layer 13 containing a photoabsorption pigment. In this case, both the dielectric layer 13 and the barrier rib 14 may again have similar properties as described above, by applying a colored glaze containing a colored pigment corresponding to a display color of each pixel.

As described above, according to this invention, there is provided an improved plasma display panel capable of performing display with high luminance and high contrast, which has a layer minimizing reflection of external light on the rear side of the fluorescence layer to reduce a reflectance of the fluorescence layer.

What is claimed is:

1. A plasma display panel comprising a plurality of cells having a fluorescent material between two glass substrates, viewing-side and rear substrates, in which the fluorescent material is excited by UV energy to emit visible light, characterized in that the visible-light reflectance of the fluorescence layer is below 10% and a photoreflection layer which effectively reflects only light with a specific emission wavelength of the fluorescent material of each cell and absorbs the remaining light, is formed between a barrier rib separating cells from each other and a cell bottom surface, namely the surface of the rear substrate and the fluorescence layer formed on the inner surface of the cell.

2. An AC type of plasma display panel comprising a plurality of cells having a fluorescent material between two glass substrates, viewing-side and rear substrates, in which the fluorescent material is exited by UV energy to emit visible light, characterized in that the visible-light reflectance of the fluorescence layer is below 10% and a barrier rib separating cells from each other and a dielectric layer on a cell bottom surface, namely the surface of the rear substrate is a photoreflection layer which can effectively reflect only light with a specific emission wavelength of the fluorescent material and absorb the remaining light.

3. A plasma display panel comprising a plurality of cells having a fluorescent material between two glass substrates, viewing-side and rear substrates, in which the fluorescent material is excited by UV energy to emit visible light, characterized in that a gray photoreflection layer which does not have a wavelength distribution, is formed between a barrier rib separating cells from each other and a cell bottom surface, namely the surface of the rear substrate and the fluorescence layer formed on the inner surface of the cell, wherein the visible-light reflectance of the fluorescence layer is below 10%.

4. An AC type of plasma display panel comprising a plurality of cells having a fluorescent material between two glass substrates, viewing-side and rear substrates, in which the fluorescent material is excited by UV energy to emit visible light, characterized in that a barrier rib separating cells from each other and a dielectric layer on a cell bottom surface, namely the surface of the rear substrate is a gray photoreflection layer which does not have a wavelength distribution and can absorb light, wherein the visible-light reflectance of the fluorescence layer is below 10%.

* * * * *